United States Patent [19]

Wells et al.

[11] 4,291,611

[45] Sep. 29, 1981

[54] AUTOMATIC LOADING DEVICE

[75] Inventors: Warren W. Wells, Radcliffe, Ky.; Robert E. Strohman, East Moline, Ill.; Harold H. Wiese, Davenport, Iowa

[73] Assignee: The United States of America as represented by the Secretary of the Army, Washington, D.C.

[21] Appl. No.: 86,235

[22] Filed: Oct. 18, 1979

[51] Int. Cl.[3] ..... F41F 9/10

[52] U.S. Cl. ..... 89/47

[58] Field of Search ..... 89/33 A, 33 B, 45, 47

[56] References Cited

U.S. PATENT DOCUMENTS 2,122,423 7/1938 Joyce ..... 89/33 A 2,975,678 3/1961 Finn ..... 89/45

*Primary Examiner*—Stephen C. Bentley

*Attorney, Agent, or Firm*—Nathan Edelberg; Robert P. Gibson; Robert O. Richardson

[57] ABSTRACT

An automatic loading device consisting of a magazine of rounds of ammunition, a tray and rammer assembly to receive a round from the magazine as the gun tube recoils from firing a previous round, means responsive to counter recoil movement of the gun tube for moving the tray into position for loading a round into the gun chamber, cable means for releasing a rammer mechanism to exert forward movement against the round to move it forward into the gun chamber and close the gun breech. A fluid drive means retracts the rammer to cocked position during recoil to enable it to operate (move the round forward) during counter recoil of the gun tube.

8 Claims, 11 Drawing Figures

AUTOMATIC LOADING DEVICE

GOVERNMENT RIGHTS

The invention described herein may be manufactured and/or used by or for the Government for governmental purposes without the payment of any royalty thereon.

BACKGROUND OF THE INVENTION

For many years fully automatic weapons have proved their value in combat forces. Weapons such as automatic rifles, submachine guns, and machine guns increase the fire power of military forces while keeping the number of weapons required to a minimum. This is true for ground forces as well as for weapons used as aircraft armament.

While small arms weapons and aircraft armament systems have enjoyed the rapid fire capabilities of automatic weapons for years, this is not true of artillery weapons. Artillery weapons require manual reloading between each round fired. A factor which affects the firing rate of artillery weapons is the bore size of the weapon which determines the size and type of ammunition used. Generally, the larger the bore size, the heavier and more cumbersome the ammunition. Many times, artillery ammunition requires loading of the projectile and propellent charge separately. This would obviously reduce the firing rate of these weapons. Therefore, the efficiency of the weapon crew determines, to a large extent, the firing rate of the weapon.

Vehicle mounted artillery weapons suffer space limitations which makes efficient execution of the loading and firing sequence much more difficult. Additionally, vehicles such as tanks normally fire high velocity armor piercing ammunition which is much heavier than comparable explosive rounds. For these reasons fully automatic tank cannon weapons are extremely desirable. Obviously, a tank with the capability of firing a round per second has a much greater hit and kill probability than conventional systems which can fire only three or four rounds per minute.

Additionally, a great cost savings could be realized by utilizing fully automatic tank cannon weapons since the same or greater fire power can be obtained from fewer weapons. Considering the extremely high cost of armored systems, the savings could be quite significant.

SUMMARY OF THE PRESENT INVENTION

The present invention is a loader-rammer system which eliminates the need for manual loading of tank cannon weapons. By elimination of this manual process a firing rate of one round per second can be achieved. By comparison, conventional systems may take twenty to thirty seconds between firings.

The loader-rammer system described herein is self-powered and operated by the recoil motion (rearward movement of the gun tube) of the weapon. With modification, it can be adapted to nearly any artillery or tank type of weapon system. This description, however, will deal with a 60 MM automatic cannon designed for anti-armor vehicle mounted applications.

The present invention utilizes a recoiling gun tube having actuating cams attached to the breech end thereof. The cams serve to pivot the rammer and loading tray assembly between the chambering position and the round receiving position. After firing of the weapon the recoiling parts engage a piston within a cocking cylinder. Further recoil movement forces hydraulic fluid from the cocking cylinder into the rammer. This moves the rammer to the cocked position where it is automatically latched.

The weapon breech is opened during the recoil cycle by a cam arrangement which will be discussed in detail subsequently. The breech opening is timed to utilize residual chamber pressure from the previous firing to aid in extraction of the fired case.

The rammer and tray assembly is pivoted up and out of the path of the recoiling parts. Near the end of the recoil stroke the rammer and tray contact release actuators on the ammunition magazine, causing a round to drop into the loading tray.

During counter recoil (forward movement of the gun tube) the hydraulic fluid is forced back into the cocking cylinder by a low pressure nitrogen spring. The rammer and tray assembly are also pivoted back down into alignment with the gun tube during counter recoil. At a precise time in the firing sequence the rammer is automatically released. The round is driven into the chamber by a high pressure nitrogen spring which automatically causes the breech to close. The round is then fired electrically. The firing of a round initiates a new firing cycle, which continues until the firing circuit is opened.

DETAILED DESCRIPTION OF ILLUSTRATIVE EMBODIMENTS

Figures 1, 11:
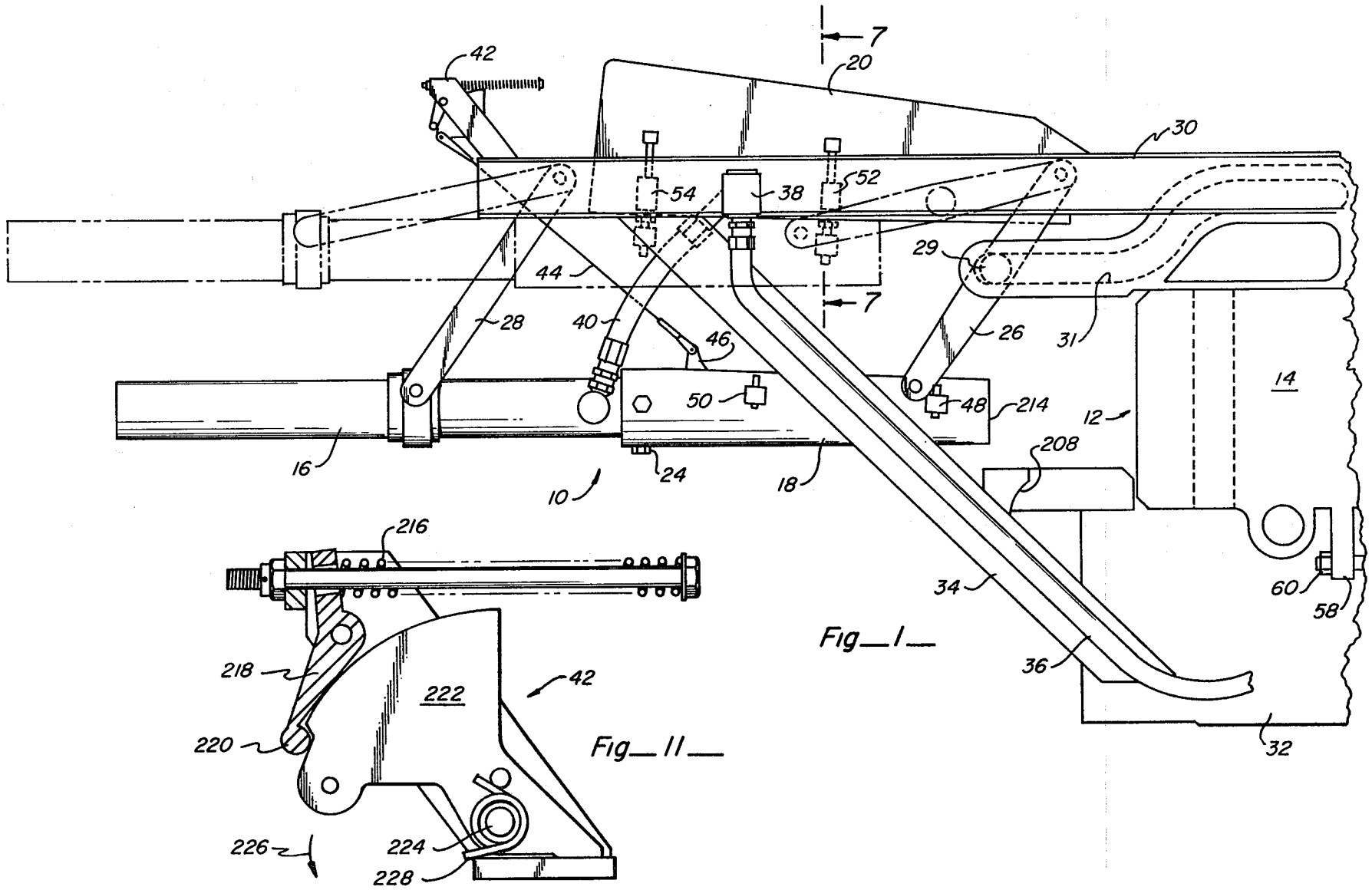
FIG. 1 is a side elevational view of the rammer-loader system and weapon assembly.
FIG. 11 is a partial sectional view of the rammer latch actuator.

Reference is made to FIG. 1 wherein a loader-rammer 10 in accordance with the present invention is shown. The loader-rammer 10 is mounted at the breech end of the weapon system 12. The weapon 12 utilizes a recoiling type gun tube 14 which produces the energy to actuate the loader-rammer system.

Figure 2:
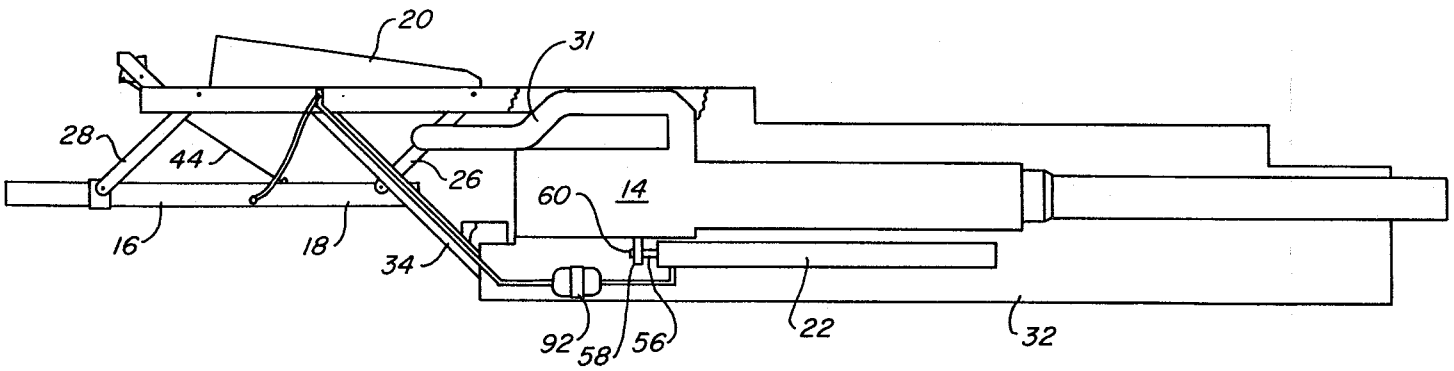
FIG. 2 is a schematic illustration of the rammer-loader system and weapon in the battery position.

The basic components of the loader-rammer system are the ramming cylinder 16, the ammunition tray 18, the ammunition magazine 20, and the cocking cylinder 22 (see FIG. 2). The ammunition tray 18 is secured to the forward end of the ramming cylinder 16 by bolts 24. This assembly is pivotally suspended by arms 26, 28, and similar arms on the opposite side (not shown), from a support structure 30 which extends from the weapon cradle 32. A rotatable cam follower 29 is mounted near the midpoint of arm 26. This cam follower 29 engages a cam track 31 which is mounted on and moves with the recoiling gun tube 14. A similar cam and follower arrangement is situated on the opposite side of the weapon (not shown).

The magazine 20 is also attached to support 30. A diagonal brace 34 and similar opposite brace (not shown) assure structural rigidity of the support 30. The brace 34 also supports a hydraulic line 36, which interconnects the cocking cylinder 22 and a hydraulic swivel connector 38. A flexible hydraulic line 40 runs from the swivel connector 38 to the ramming cylinder 16.

At the extreme rear end of support 30 is mounted an actuator 42 which releases the rammer latch. A latch release means 44 such as a flexible cable of adjustable length, extends between the rammer latch actuator 42 and the rammer latch 46. Round release actuators 48, 50 and similar actuator on the opposite side (not shown) are attached to the ammunition tray. These actuators 48, 50 contact the round release mechanism 52, 54 and similar opposite mechanisms (not shown) when the rammer 16 and tray 18 assembly pivots upwardly, as shown in phantom lines. The operation of this mechanism will be discussed in greater detail subsequently. As shown in FIG. 2 the cocking cylinder 22 is situated below the gun tube 14 and attached to the weapon cradle 32. A piston rod 56 extends from the cocking cylinder 22 through a lug 58 which projects from the gun tube 14. A nut 60 threaded to the piston rod 56 retains the rod 56 in the lug 58.

Figure 4:
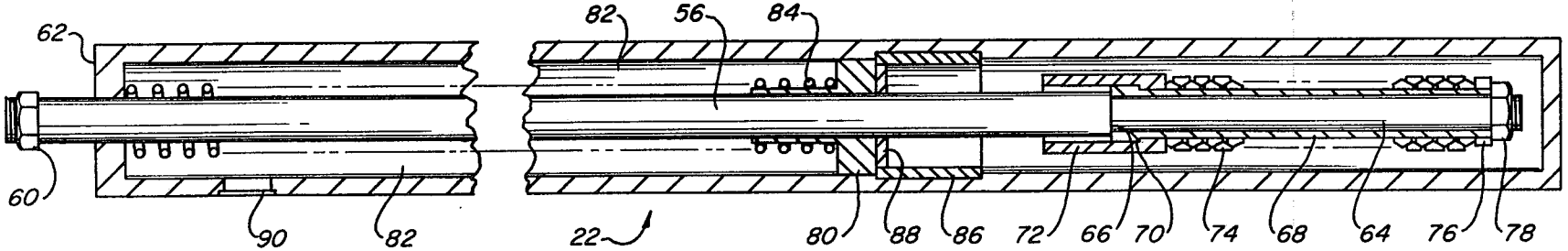
FIG. 4 is a cross sectional view of the cocking cylinder.

A detailed sectional view of the cocking cylinder is shown in FIG. 4. The piston rod 56 extends nearly the full length of the cylinder 22 and protrudes from the rear end 62 for attachment to lug 58 as previously described. The opposite end 64 of rod 56 is of a reduced diameter which creates a shoulder 66. A tubular spring guide 68 is positioned over end 64 of the rod 56 and abutts shoulder 66. The spring guide 68 has an enlarged end 70 at the rearmost end. A plunger 72 is slidably positioned over guide 68 and engages the enlarged end 70 as shown. A set of ring springs 74 are positioned in front of the plunger 72 and are secured on the guide 68 by a washer 76 and a threaded nut 78.

A hydraulic piston 80 is situated over rod 56 to the rear of the ring spring assembly. The area to the rear of the piston 80 is filled with a hydraulic fluid 82. A helical spring 84 urges piston 80 forwardly against a cushion assembly 86. This cushion assembly 86 limits the travel of piston 80 and absorbs impact during operation. A buffer pad 88 separates the piston 80 and ring spring assembly to prevent peening of the piston 80 or plunger 72 during firing. A threaded orifice 90 is provided near end 62 of the cylinder 22 for attachment of the hydraulic line 36 (see FIG. 2).

As shown in FIGS. 1 and 2 hydraulic line 36 runs through an accumulator 92 to a swivel connection 38 into flexible line 40 and ultimately to the orifice 94 (see FIG. 5) in the ramming cylinder 16.

Figure 5:
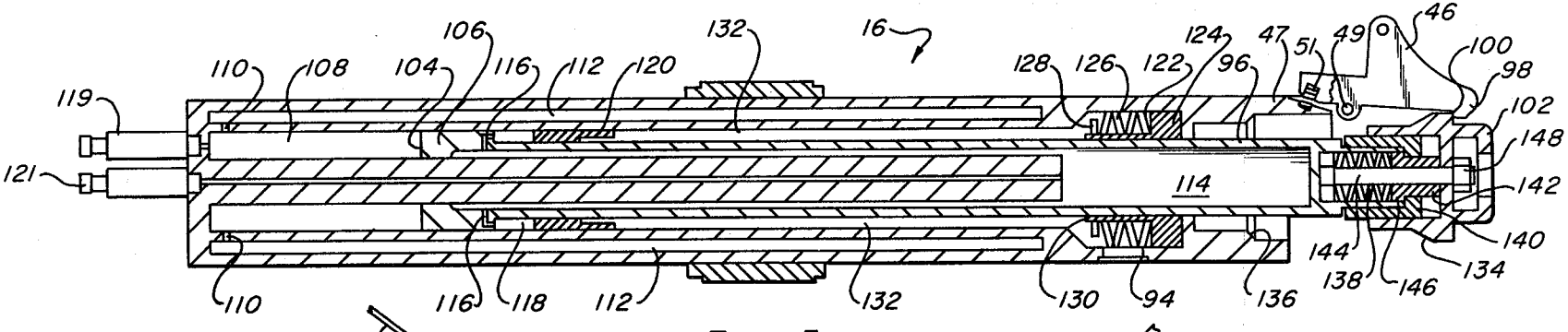
FIG. 5 is a cross sectional view of the rammer.

Reference is now made to FIG. 5 which shows the ramming cylinder 16 in cross section. The rammer 96 is shown in the latched or cocked position. A hooked end 98 of the rammer latch 46 engages a ridge 100 on the rammer head 102 to retain the rammer in this cocked position. The rammer latch 46 is pivotally attached to the rammer housing 47 by pivot pin 49. Helical spring 51 urges the latch into engagement with the rammer head. The opposite end 104 of the rammer body 96 is enlarged to form a piston 106. Pressurized nitrogen gas 108 fills the area behind piston 106. Apertures 110 allow the pressurized nitrogen 108 to communicate with an annular chamber 112. This provides a large volume and maintains nearly constant gas pressure throughout the rammer's travel. A second nitrogen gas spring, of lower pressure, fills the area 114 directly behind the rammer head 102. Apertures 116 allow communication of this gas with the area 118 between piston 106 and a floating piston 120. This urges the floating piston 120 toward the rammer head 102. Valves 119 and 121 are provided to allow instillation of the nitrogen gas.

A belleville spring assembly 122 is provided at the forward end of travel of floating piston 120. A spool 124 supports the belleville springs 126. An impact ring 128 is provided at the rearmost end 130. As the floating piston 120 moves forward, the forward end of the piston 120 engages the impact ring 128 thereby compressing springs 126 which absorb the energy of the piston 120.

The area 132 in front of the floating piston 120 communicates with orifice 94 to receive hydraulic fluid from the cocking cylinder 22 during operation.

The rammer head 102 utilizes a belleville spring arrangement to absorb impact in both directions. In this manner the rammer head 102 will absorb the impact when the rammer is driven into a projectile. Cap 140 is threaded to the rammer 96. Plug 142 is slidably positioned over bolt 144 to confine springs 138 between the plug 142 and the bolt head. The enlarged head 146 on the plug 142 engages the forward end of cap 140, which limits the forward travel of the plug 142. Bolt 144 passes through the rammer head 102 and is secured by nut 148. When the rammer 96 is retracted completely, during the cocking process, the angled surface 134 on the rammer head 102 contacts the counter bore 136 in the rammer housing 47. This displaces the rammer head 102 forwardly. This forward displacement is transferred to nut 148 through the bolt 144 which compresses the springs 138 between the bolt head and the plug 142. When ramming an ammunition round into the breech of the cannon the rammer head 102 is driven into the base of the round, displacing the rammer head 102 rearwardly. The rearward displacement is transferred to plug 142 which again compresses spring 138 thereby absorbing the impact.

Figure 6:
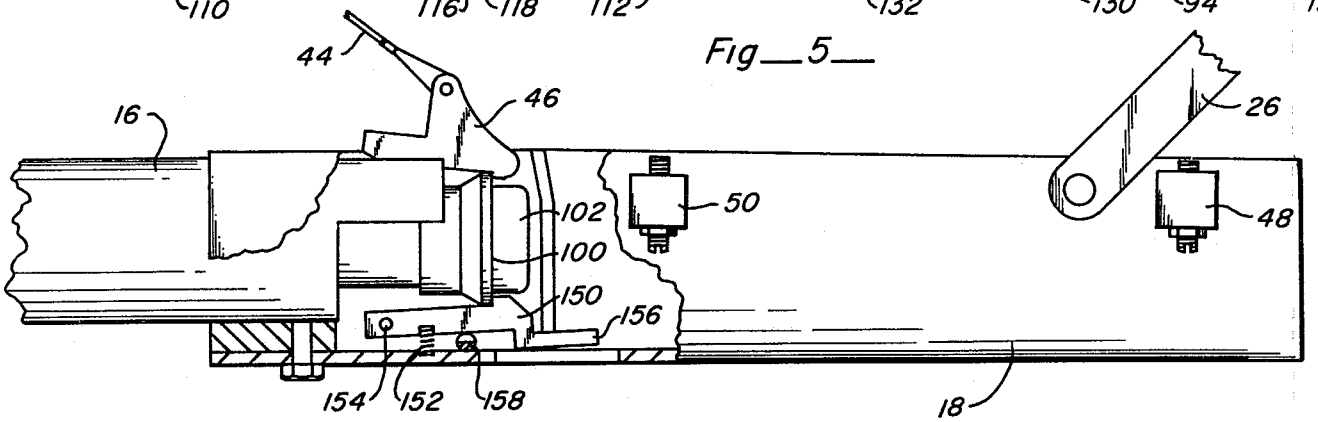
FIG. 6 is a side elevational view in partial section of the rammer and tray assembly.

Reference is now made to FIG. 6 wherein there is shown a side elevational view of the ramming cylinder 16 and ammunition tray 18 assembly. The cut away section of the ammunition tray shows a safety latch 150 which prevents a ram cycle from occurring when there is no ammunition round in the tray. The safety latch 150 is urged into engagement with the lower portion of ridge 100 on the rammer head 102 by helical spring 152. The latch is pivotally mounted to the tray by pin 154. The latch is disengaged only when an ammunition round is positioned in the tray. The base end of the ammunition round engages the projecting tip 156. The weight of the round overcomes spring 152, depresses the latch 150 and frees the rammer for normal operation. The safety latch is also equipped with a manually controlled lock. The lock consists of a rotatable notched shaft 158 which is connected to a knob (not shown) on the outer end of the shaft 158. The lock shaft 158 is shown in the unlocked position. However, by rotating the knob 180° the solid portion of shaft 158 restricts the movement of the safety latch 150. This allows hand loading of the weapon without the danger of accidentally tripping the rammer.

Figure 7:
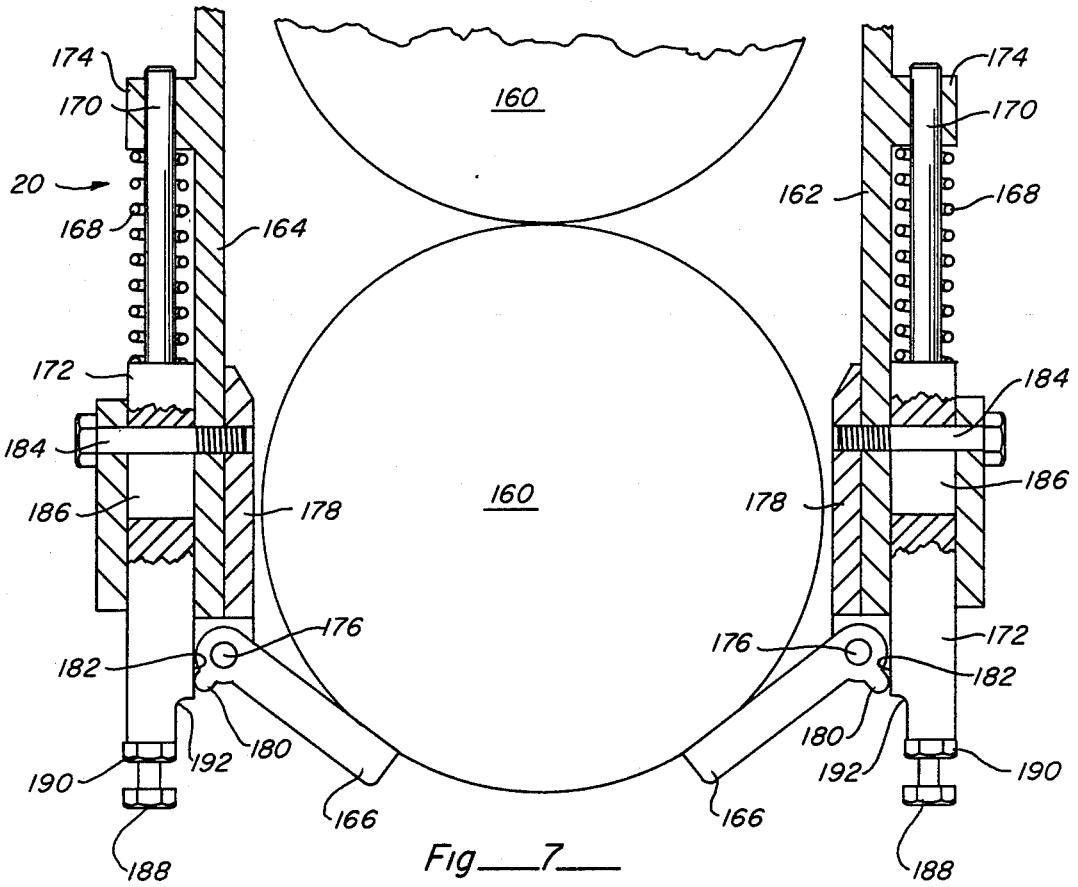
FIG. 7 is a cross sectional view of the ammunition magazine taken on line 7—7 in FIG. 1.

FIG. 7 is a cross sectional view of the ammunition magazine 20 showing two of the round release mechanisms. The ammunition rounds 160 are loaded into the open top of the magazine 20. The rounds 160 are supported between the side walls 162 and 164 and at the bottom by the release levers 166. The release levers 166 are pivotally mounted by pins 176 to supports 178. The levers 166 are provided with ears 180 which engage the inner surfaces 182 of the release plungers to keep the levers 166 in the extended position shown. Helical springs 168 surround guide rods 170 which extend from the upper ends of the release plungers 172. The springs 168 abut projections 174 to urge the release plungers 172 downwardly. Bolts 184 extend through elongated slots 186 to limit the travel of, and retain, the plungers 172. Bolts 188 and lock nuts 190 are provided for adjustment. The heads of bolts 188 are depressed by actuators 48 and 50 which are also provided with adjustment screws and lock nuts (see FIGS. 1 and 5). Displacement of plungers 172 by actuators 48 and 50 aligns the notches 192 on the release plungers 172 with the ears 180 on the release levers 166. The weight of the rounds 160 in the magazine 20 causes the levers 166 to swing to a vertical position, allowing the lowermost round to drop into the ammunition tray 18 (see FIG. 1). When the plungers 172 are released, springs 168 force them back to the position shown in FIG. 7, which forces the levers 166 back to the extended position as shown.

Figure 8:
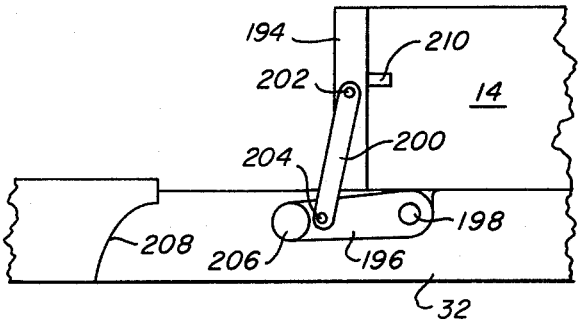
FIG. 8 is a schematic view of the breech opening cam showing the breech in the closed position.
Figure 9:
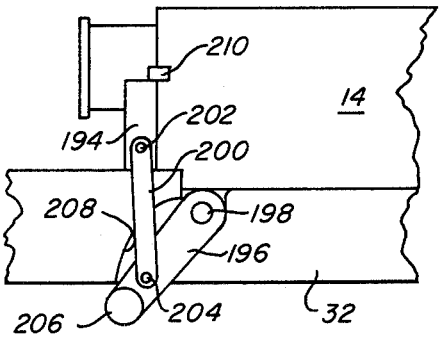
FIG. 9 is similar to FIG. 8 showing the breech in the open position.
Figure 10:
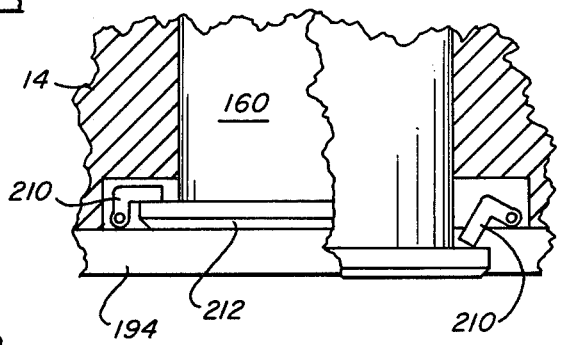
FIG. 10 is a cross sectional view of the weapon chamber showing the extractor operation.

FIGS. 8–10 schematically show the operation of the breech opening cam and the extractors. In FIG. 8 the gun tube 14 is in the battery position and the weapon breech 194 is fully closed. The breech is biased to the closed position by a spring (not shown). A cam lever 196 is pivotally attached to the gun tube 14 at 198. A link 200 is pivotally connected to the breech 14 and lever 196 at 202 and 204 respectively. A cam follower 206 is situated at the rearward end of lever 196. As the gun tube recoils the cam follower 206 engages an arcuate cam 208. This forces the lever 196 to pivot downwardly as shown in FIG. 9. This action causes the breech 194 to slide downward due to the interconnection of the breech 194 and lever 196 by link 200. When the breech has reached the fully opened position the extractors 210 are pivoted rearwardly by torsion springs (not shown), as illustrated on the right side of the broken line in FIG. 10. This action initiates the extraction of the fired cartridge 160 and restricts the upward movement of the breech 194. When a fresh round is chambered the cartridge rim 212 pivots the extractors back to the position shown on the left side of the broken line in FIG. 10. This action frees the breech 194, which then returns to the closed position under the urging of its spring.

A detent arrangement is provided on the latch actuator 42 to prevent breakage of the cable 44 (see FIG. 11). Spring 216 urges detent 218 into engagement with notch 220 on cam 222. Downward motion of the rammer 16 and tray 18 assembly continues after the rammer is released. During this downward movement, the cam 222 pivots at pin 224 in the direction of arrow 226. Spring 216 is of adequate strength to assure release of the rammer latch 46 before disengagement of detent 218 with notch 220. Torsion spring 228 returns the cam to the position shown during recoil.

OPERATION

A complete firing cycle will now be described to provide a more thorough understanding of the loader-rammer operation. FIGS. 1 and 2 show the weapon in the battery position. Assuming a round is chambered, the weapon is ready for firing. The round is detonated by conventional electrical means, well known in this art (not shown). Upon firing, the gun tube 14 initiates recoil motion. The interconnection of piston rod 56 with lug 58 causes the piston rod 56 to be withdrawn from the cocking cylinder 22. The gun tube recoils approximately 5.5 inches before the plunger 72, in the cocking cylinder 22, contacts the buffer 88 adjacent piston 80 (see FIG. 4). During this initial recoil movement, the gun tube moves rearwardly until the weapon breech is directly adjacent the forward edge 214 of the ammunition tray 18. During this period, the tray 18 and rammer 16 assembly remains stationary as the roller follower 29 tracks the flat dwell portion of cam track 31.

As recoil continues, the plunger 72 in the cocking cylinder 22 engages the buffer 88 which causes piston 80 to be displaced rearwardly (see FIG. 4). The ring springs 74 absorb the impact between the plunger 72 and the piston 80, when engagement occurs. As piston 80 is moved rearwardly, hydraulic fluid 82 is forced out orifice 90 through the connecting lines 36 and 40 to the ramming cylinder. The rammer 16 is of course extended forwardly after completing the previous ram cycle.

Hydraulic fluid flows into the ramming cylinder through orifice 94 (see FIG. 5) which is connected to flexible line 40. The hydraulic fluid forces floating piston 120 rearwardly against rammer piston 106. As the gun tube 14 reaches the rearmost limit of its travel, a sufficient volume of hydraulic fluid has been transferred to the ramming cylinder to retract the ridge 100 on the rammer head 102 past the rammer latch 46. When this occurs, the latch 46 is urged into engagement with ridge 100 by spring 51.

Figure 3:
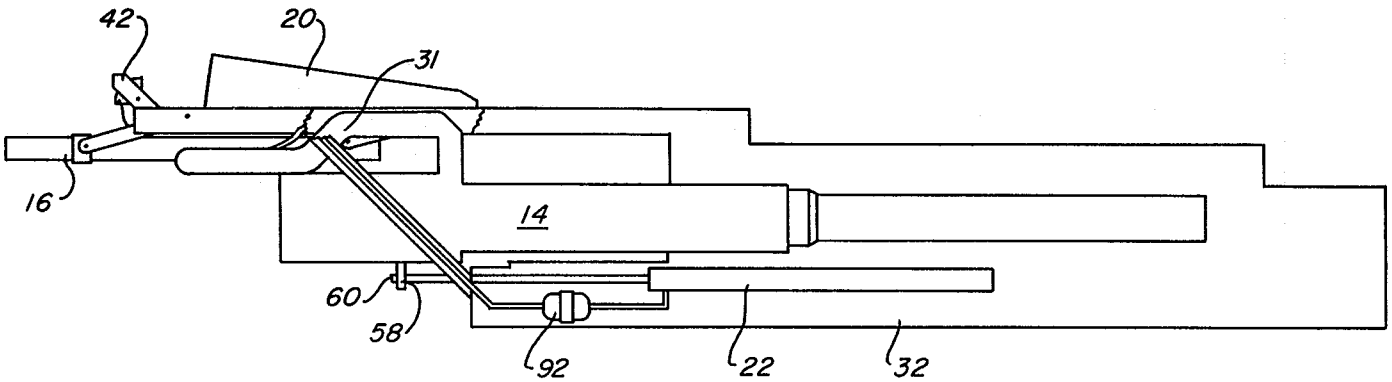
FIG. 3 is similar to FIG. 2 showing the weapon in the recoil position.

Concurrent with these events, the rammer 16 and tray 18 assembly is being pivoted upwardly by the action of the roller 29 in cam track 31 (see FIG. 1). By the end of the recoil stroke the rammer 16 and tray 18 assembly has been pivoted completely out of the path of the recoiling gun tube 14. Additionally, as the rammer 16 and tray 18 assembly reaches its uppermost position, the round release mechanisms are contacted by the actuators 48, 50 allowing an ammunition round to drop into the ammunition tray 18. The weapon components are now in the recoil position as illustrated in FIG. 3 and in phantom lines in FIG. 1.

The breech 194 of the weapon is also opened, by the cam arrangement previously described, during recoil. The breech opening is precisely timed to utilize residual chamber pressure, from the previous firing, to aid in extracting the spent cartridge casing.

The gun tube 14 is returned to the battery position by a conventional recoil mechanism well known in this art (not shown).

As counter recoil motion progresses, piston rod 56 is returned toward its starting position shown in FIG. 4. Piston 80 is urged forwardly by return spring 84. Cushion 86 is provided to absorb the impact of piston 80 on its return stroke.

Simultaneously, floating piston 120 in ramming cylinder 16 is urged fowardly by compressed nitrogen spring 114. The nitrogen gas circulates through apertures 116 in piston 106 to force floating piston 120 forwardly. As piston 120 moves back to its forwardmost position the hydraulic fluid is returned through connecting lines 36 and 40 to the cocking cylinder 22.

Concurrently the rammer 16 and tray 18 assembly is pivoted downwardly by the action of cam follower 29 in cam track 31. As the rammer 16 and tray 18 assembly approaches the lower limit of its travel, cable 44 is drawn tight. The breech end of the gun tube 14 is positioned directly adjacent the forward edge 114 of the ammunition tray 18 at this time. As the rammer 16 and tray 18 assembly pivots further downward the rammer latch 46 is pivoted upwardly by the tightened cable 44, thereby freeing the rammer head 102. The rammer body 96 is then urged forwardly by the compressed nitrogen 108 acting on piston 96. As the rammer 96 extends forwardly the head 102 engages the ammunition round in the tray and displaces it into the weapon chamber. As the round is chambered the breech 144 is automatically closed as previously described.

This completes the weapon cycle of operation. As long as the magazine is loaded and the firing circuit is closed, the firing cycle will continually repeat. A firing rate of approximately one round per second has been achieved with this mechanism, representing a significant advancement over manually loaded and fired weapons.

The invention in its broader aspects is not limited to the specific combinations, improvements and instrumentalities described but departures may be made therefrom within the scope of the accompanying claims without departing from the principles of the invention and without sacrificing its chief advantages.

We claim:

1. An automatic loading device for loading ammunition rounds into a gun tube chamber, said device comprising a magazine, a tray-rammer assembly responsive to gun recoil and counter recoil forces for removing a round from said magazine and placing it in said gun tube chamber, said assembly including a loading tray and a rammer mechanism, said rammer mechanism moving said round from said tray into said chamber, said loading tray being moved to a round receiving position under said magazine upon gun recoil and moved to a round chambering position upon gun counter recoil, said gun tube being supported by a gun carriage and said tray being suspended by links from said gun carriage, a cam follower mounted on said links and a cam track mounted on and moving with said gun tube, said cam follower being positioned in said cam track whereby recoil of said gun tube moves said tray into said round receiving position and counter recoil of said gun tube moves said tray into said round chambering position.

2. An automatic loading device as set forth in claim 1 wherein said rammer mechanism is mounted on said tray for movement therewith, said rammer mechanism comprising a rammer and a rammer housing, said rammer housing being attached to said tray, said rammer being adapted to move relative to said rammer housing, said rammer having said relative movement when said tray has reached said round chambering position.

3. An automatic loading device as set forth in claim 2 wherein said rammer has a cocked position and an extended position relative to said rammer housing, pressure means for moving said rammer from cocked position to said extended position, latch means for retaining said rammer in said cocked position, and release means for activating said latch means when said tray has reached said round chambering position.

4. An automatic loading device as set forth in claim 3 wherein said gun tube moves between battery and recoil positions on a gun carriage and said release means includes a rammer latch actuator operable when said tray has reached said round chambering position, said actuator comprising a cable between said latch means and said carriage to release said latch.

5. An automatic loading device as set forth in claim 4 wherein said tray and rammer assembly moves from said round receiving position to a position beyond said round chambering position and toward the battery position of said gun tube, and expander means for increasing the effective length of said cable when said assembly travels beyond said round chambering position.

6. An automatic loading device as set forth in claim 3 wherein said rammer housing comprises a cylinder, said rammer includes a piston within said cylinder, and said pressure means includes a high pressure gas in said cylinder urging said piston outwardly therefrom.

7. An automatic loading device as set forth in claim 3 including cocking means for moving said rammer from said extended position to said cocked position, said cocking means including a cocking cylinder mounted on the gun carriage, said cocking cylinder having a piston rod therein connected to said gun tube, fluid within said cylinder, said piston rod pumping said fluid from said cylinder as said gun tube recoils, said rammer having a rammer piston thereon, said rammer housing having a fluid connection with said cocking cylinder whereby fluid pumped from said cocking cylinder is urged against said rammer piston to drive said rammer to cocked position.

8. An automatic loacing device as set forth in claim 7 wherein said ramming cylinder has a floating piston therein between said rammer piston and said fluid, a low pressure gas between said floating piston and said rammer piston whereby fluid in said rammer cylinder is urged back into said cocking cylinder upon counter recoil of said gun tube.

* * * * *